United States Patent [19]

Sama

[11] Patent Number: 4,532,662

[45] Date of Patent: Aug. 6, 1985

[54] MODIFIED WATERBED

[76] Inventor: Nicholas Sama, 19120 Bel Aire Dr., Miami, Fla. 33157

[21] Appl. No.: 565,706

[22] Filed: Dec. 27, 1983

[51] Int. Cl.[3] ..... A47C 27/08

[52] U.S. Cl. ..... 5/450; 5/451

[58] Field of Search ..... 4/451, 450, 400, 452, 4/481

[56] References Cited

U.S. PATENT DOCUMENTS

| | | | |
|---|---|---|---|
| 3,574,873 | 4/1971 | Weinstein | 5/451 |
| 3,742,531 | 7/1973 | Alsbury et al. | 5/451 |
| 4,167,049 | 9/1979 | Fogel | 5/451 |
| 4,187,566 | 2/1980 | Peterson | 5/451 |
| 4,245,361 | 1/1981 | Evanson | 5/450 |
| 4,370,768 | 2/1983 | Saloff | 5/450 |
| 4,411,033 | 10/1983 | Morgan | 5/451 |

FOREIGN PATENT DOCUMENTS

| | | | |
|---|---|---|---|
| WO80/01036 | 5/1980 | PCT Int'l Appl. | 5/451 |
| 2099296 | 12/1982 | United Kingdom | 5/451 |

*Primary Examiner*—Alexander Grosz

*Attorney, Agent, or Firm*—Robert J. Van Der Wall

[57] ABSTRACT

A modified waterbed is provided comprising a liquid-containing mattress or bladder, a resiliently compressible, elastomeric material, porous as to the liquid forming a resilient insert disposed within the bladder, and a resilient base positioned at least in part beneath the bladder and having properties that are similar to the properties of the resilient insert. The resilient insert and resilient base have as one of those properties a function defined as displacement force divided by penetration depth, and that property of each is substantially similar to the other. In a preferred embodiment the bladder will be surrounded laterally with a resilient perimeter member to laterally contain the bladder, said resilient perimeter member being stiffer in terms of the displacement function divided by penetration depth than the similarly defined function of both the resilient base and resilient insert. The preferred embodiment also includes a support structure and the use of a convoluted foam as the material utilized for the resilient insert.

18 Claims, 7 Drawing Figures

MODIFIED WATERBED

FIELD OF THE INVENTION

This invention relates to the field of beds of a type having a mattress filled with a liquid, usually water, and generally termed waterbeds. It relates in particular to waterbeds having mattresses with free standing sides, i.e., those absent a substantially rigid vertical or side support around the periphery of the mattress. The latter type of waterbed are popularly known as soft-sided waterbeds.

BACKGROUND OF THE INVENTION

While the development of waterbeds has provided a new concept in sleeping comfort, there have been a series of problems associated with these devices. Perhaps the best known is the wave phenomenon. That is, a force suddenly applied to one portion of a waterbed mattress results in a propagation of a wave across the mattress which is then bounced off the wall of the mattress and returned somewhat in the manner of a wave in a swimming pool. Previous inventive efforts to minimize the wave phenomenon have largely involved the insertion of baffles into the mattress structure or floating material on top of the water surface that resists the wave phenomenon. These developments have had some moderate success in reducing the wave phenomenon, but usually do not completely eliminate that problem.

A second common problem has been the hammock-like support experienced by user of waterbeds. Hammock-like support is inherent in the construction of ordinary waterbed mattresses, because body support is accomplished mainly by a taut flexible material which contains the water and there results a disposition of the body such that the trunk is in a lowermost position with the legs and arms and head thrust upward and outward. Nothing illustrates this better than the uncomfortable tendency of two people who "roll together" when they lie close together on a waterbed. Since hammock-like support is not truly comfortable, it remains a point of dissatisfaction for many waterbed users. Insertion of materials within the mattress, such as those inserted to reduce waves, provide minimal improvement in this problem.

A third problem concerns the bottoming effect, which results because a conventional waterbed mattress is placed upon a rigid plane to provide uniform support for the entire lower surface of the waterbed mattress. The conventional solution to this problem has been to use nine to twelve inch deep waterbed mattresses in an attempt to create sufficient depth in the mattress to avoid reaching bottom when a sudden localized force is applied. Even so, it is still possible with this depth of water to hit bottom with a sudden localized force, and this attempted solution leads to several additional waterbed problems which tend to be inherent with the waterbed concept, but are aggravated by the deep fill attempted solution to the bottoming effect.

A great many waterbeds are made with a frame which contains the periphery of the waterbed mattress. Particularly when a deep fill solution is attempted to resolve the bottoming effect, a large lateral outward force is generated against the containing frame, so that massive (usually two 2"×10") timbers are necessary to withstand it. These are uncomfortable to sit upon, and even if padded, create a strong tendency to tumble inward when sat upon. Thus, the deep fill solution to the bottoming effect increases the need for a lateral frame, which in turn causes the tumble inward difficulty and edge sitting discomfort difficulty as collateral problems.

Moreover, the deep fill solution makes the waterbed extremely heavy. With a nine inch or greater fill, the water alone weighs about two thousand pounds, and massive structure is required to support the mattress both vertically and laterally. Many residential structures were never designed to support such a large concentration of weight as results from such a piece of furniture, giving rise to very reasonable concerns on the part of both waterbed owners and their landlords.

In addition, the large volume of water becomes too great of a quantity to readily reach thermal equilibrium with typical cyclical variations in ambient room temperature on a daily basis. Accordingly, substantial condensation takes place on the waterbed surface unless the water within the mattress is heated to a temperature that prevents such condensation. Usually electric heaters are employed with automatic or semi-automatic controls, but there is the additional expense of acquisition and especially the cost of operation which may be up to $250.00 per year in northern climates. Some would also argue that such electrical heating apparatus represents a safety hazard in close proximity to such a large volume of water.

Consequently, the actually unsuccessful deep fill solution to bottoming effect creates, at least in part, a number of collateral concerns which include edge sitting discomfort, the tumble in effect, tremendous weight, lack of thermal equilibrium with cyclic room temperature variations, the necessity to heat the water and to control that heating, and finally, the consequent safety hazard. Furthermore, there still exists the problems of eliminating the wave phenomenon and the hammock-like support discomfort.

SUMMARY OF THE INVENTION

Bearing in mind the foregoing, it is a principal object of the invention to modify the waterbed structure in a way to attack all of the foregoing problems.

Another principal object of the invention is to accomplish the foregoing with no diminution in the uniform support advantages of the waterbed concept.

An additional object of the invention is to achieve the foregoing objectives without substantial increases in the cost of a waterbed and, indeed, with efficiencies in the structure of a waterbed.

It has been shown that a majority of the problems with conventional waterbed design developed from the attempted deep fill solution to the bottoming effect. This, in turn, leaves one to pause and consider if the addition of more and more depth is a reasonable way to eliminate bottoming. Indeed, the present invention substantially eliminates bottoming by reducing the thickness of the waterbed mattress substantially, by placing an insert within the mattress, and by adding a resilient base.

Therefore, in accordance with the invention there is provided a water containing mattress or bladder, a resilient insert member disposed within the water mattress, a resilient base beneath the bladder, and conventional support structure including a pedestal and decking. In a preferred embodiment there is also included a resilient perimeter about the water mattress or bladder in a configuration similar to the rigid containing frame of conventional waterbeds. The important feature of the invention is that the force necessary to deflect the resilient insert member should be substantially identical to the force necessary to deflect the resilient base so that the boundary between the lower surface of the water mattress or bladder and the upper surface of the resilient base cannot be felt by applying a force to the top of the bladder.

The invention will be better understood upon reference to the detailed descriptions of the preferred and alternative embodiments that follow and the drawings in which:

DETAILED DESCRIPTION

The physiological sensation called bottoming in a waterbed has a simple dynamical explanation, which, in turn, points to a remedy for all of the foregoing problems. Consider FIG. 1, which, in part, depicts qualitatively the displacement force required to produce a given penetration depth on a conventional waterbed. The mattress is assumed to be nine inches deep and rests directly on a rigid plane which uniformly supports the entire lower surface of the waterbed mattress. The curve "a" represents the displacement force vs. penetration depth relationship for water. The curve "b" represents an actual curve of the same relationship which results from the sum of curve "a" plus an increasing increment of non-local resistance introduced by the covering surface of the water mattress, normally vinyl sheet, as penetration depth increases. The curve "c" shown as a substantially vertical line, represents the displacement force vs. penetration depth relationship for the substantially rigid plane or decking, which is encountered at a penetration depth of nine inches below the waterbed mattress upper surface. It is substantially vertical because once a depth of nine inches is reached (assuming a nine inch thick waterbed mattress and ignoring the thickness of the bladder walls), the displacement force increases toward infinity with virtually no further penetration depth.

Figure 1:
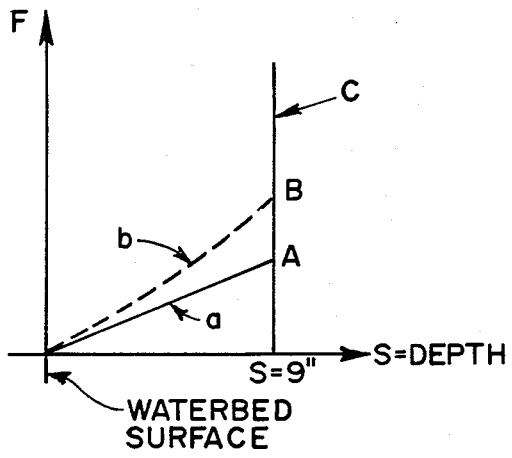
FIG. 1 is a graph plotting displacement force against penetration depth of a waterbed.

It should be noted that there is an abrupt change in force per unit penetration, which could be expressed mathematically as a discontinuity in the derivative dF/dS. This discontinuity in dF/dS occurs with either the idealized curve "a" or the actual curve "b" at point A or B respectively where such curves intersect with the curve "c" for the substantially rigid decking. This abrupt discontinuity in dF/dS corresponds exactly, of course, to the abrupt change in "feel" which the body senses perceive as bottoming. Thus, FIG. 1 depicts the conclusion that if the discontinuity in dF/dS can properly be eliminated, then the feel of the bottoming effect will vanish. The solution to the bottoming effect problem is, therefore, to bring about a situation wherein the displacement force/penetration depth relationship is smooth and free of abrupt changes.

Figure 2:
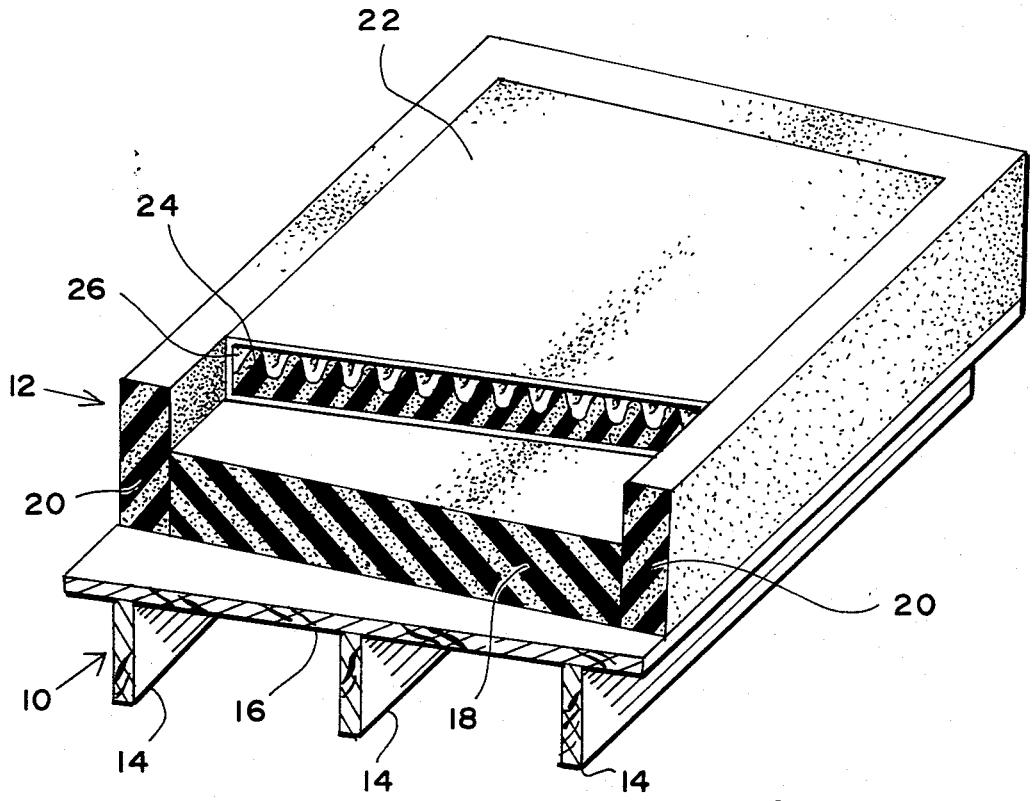
FIG. 2 is a broken cross-sectional perspective view of the preferred embodiment of the invention.

This requirement can be achieved by the preferred embodiment of the invention as illustrated in FIG. 2. FIG. 2 generally shows a supporting structure 10 and a multi-component waterbed assembly 12 disposed thereon. The supporting structure is typically composed of a plurality of vertical supports or pedestal members 14 and a substantially rigid horizontal plane or decking 16 supported by pedestal members 14.

Disposed thereon are resilient base 18, resilient perimeter 20, a waterproof bladder 22, normally fabricated from heavy wall vinyl sheet, and within which is contained a porous resilient insert 24 and water 26.

The pedestal members 14 and decking 16 are merely support structures, are frequently made from wood, and are common to most waterbeds. Their construction and appearance can be varied without affecting the invention.

Examining now the waterbed assembly, the resilient base 18 and resilient perimeter 20 are preferably comprised of a resiliently compressible, flexible, elastic material such as polyurethane foam having characteristics hereinafter described. The bladder 22 is of a type commonly available in the present waterbed industry, is impermeable to water, and generally made of 20 mil vinyl sheet. The resilient insert 24 is fashioned preferably of what is known in the packaging and upholstery industries as reticulated foam "or convoluted foam " of a type typically having 20–30 pores per inch and is also comprised of a resiliently compressible, flexible, elastic material which is porous to water or any substitute liquid employed, since it will be filled with and immersed in such liquid. Other characteristics will be hereinafter described.

The present invention will be described in its preferred embodiment utilizing dimensions actually used in constructing prototypes, but it will be understood that such dimensions are illustrative only and not by way of limitation. The preferred vertical dimension of the bladder 22 was evolved from the observation that the maximum useful conformance depth for the adult human body is approximately two inches. By this is meant the depth to which one may "sink" into a supporting structure such as a bed, and still feel comfortable. Beyond a depth of two and one half inches or so, there is a sense of engulfment which very soon leads to discomfort. Thus it was decided that a three inch depth for the bladder should be adequate, and consequently, the preferred vertical dimensions in FIG. 2 were established, at least in part, with a view toward making the waterbed assembly the same size as a conventional (non-waterbed) mattress. Not to be overlooked is the fact that such a development would permit the use of conventional linens, the waterbed assembly could then be placed on a conventional box spring and no special arrangements for conversion of a conventional bed to a waterbed would be required. Thus if a three inch depth for the bladder 22 is selected, and noting that a conventional mattress is six to seven inches thick, four inches can be selected as the thickness of the resilient base 18. This would result in a depth of seven inches for the resilient perimeter 20.

It should be noted that for optimum results, two conditions are of paramount importance. These are that (a) the height of the resilient insert 24 should be substantially the same as that of the bladder 22 when filled with water, and (b) the material of the resilient insert 24 must have substantially the same displacement force/penetration depth characteristics as the material of the resilient base 18. In the parlance of the flexible foam industry, the resilient insert 24 and resilient base 18 would be said to have approximately the same Indentation Load Deflection (ILD). These two conditions are, in fact, the essence and focus of the present invention. When the resilient insert 24 and resilient base 18 function in combination under conditions (a) and (b) above, they co-act to produce an unexpected and highly beneficial effect which sets the invention completely apart from the prior art.

Figure 3:
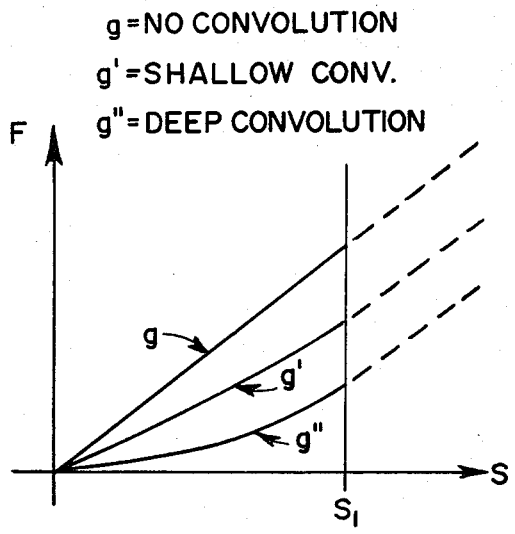
FIG. 3 is also a graph plotting displacement force against penetration depth for three different physical configurations of the resilient insert member which illustrates by extrapolation the effect of the resilient base.
Figure 4:
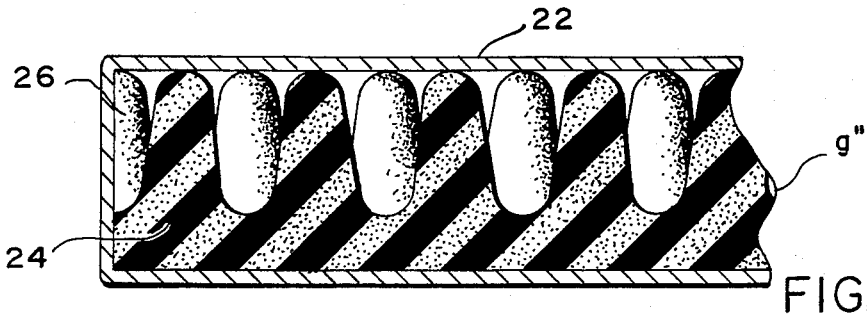
FIG. 4 is a broken cross-section of a portion of one embodiment of a waterbed mattress having deep convolutions in the resilient insert.
Figure 5:
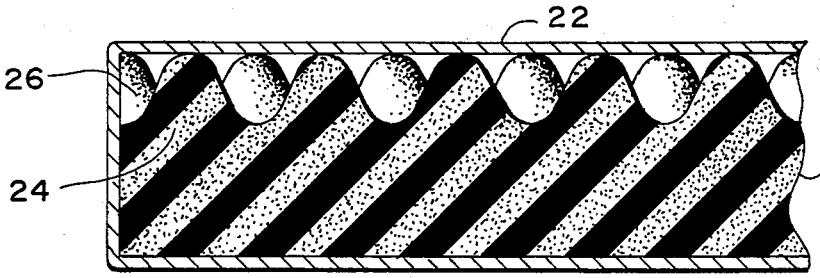
FIG. 5 is also a broken cross-section of a portion of a waterbed mattress showing shallow convolutions in the resilient insert.
Figure 6:
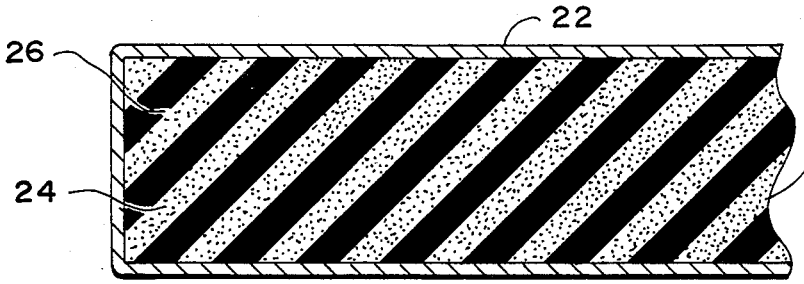
FIG. 6 is also a broken cross-section of a portion of a waterbed mattress showing the resilient insert with zero or no convolutions.

The dynamical behavior of the present modified waterbed (and its corresponding physiological effects) can be readily understood by reference to FIGS. 3 through 6. It can be readily shown that a convoluted foam has displacement force vs. penetration depth curves as shown in FIG. 3. FIGS. 4, 5 and 6 show respectively deep convolution, shallow convolution, and no convolution in a broken cross-sectional view of the waterbed mattress of the present invention. All represent alternatives for the present invention, with the preferred embodiment being a matter of taste. In each instance the bladder 22, resilient insert 24, and water or substitute liquid 26 is shown. Also shown are reference letters g, g′, and g″ which correspond to the three curves shown in FIG. 3. The three curves in FIG. 3 have differing displacement force vs. penetration depth relationships which are dependent upon the degree of convolution such that as the degree of convolution decreases, the stiffness of the waterbed assembly increases.

Examining FIG. 3 more closely, it will be noted that $S_1$ is the depth of both the resilient insert 24 and the water mattress bladder 22. It will be seen to the right of $S_1$ in FIG. 3 that the displacement force vs. penetration depth characteristics, or slope, of the resilient base has been extrapolated in dashed lines. The slope in each instance is, of course, identical because that characteristic of the resilient base 18 is selected independently of the extent of the convolution represented by curves g, g′ and g″ of the resilient insert 24.

Since the resilient insert 24 is of substantially the same height as the water mattress bladder 22, that resilient insert 24 begins to contribute support immediately upon any downward penetration of the waterbed surface, with this contribution increasing with increasing penetration in a manner appropriate to the degree of convolution as shown in the series of curves shown in FIG. 3, g, g′ and g″. Because the resilient base 18 is fashioned of a material having approximately the same deflection force vs. penetration depth characteristics, or ILD, as the resilient insert 24, a sudden localized force or load resulting in penetration beyond the depth $S_1$ will transit smoothly across the boundary between the lower surface of the bladder 22 and the upper surface of the resilient base 18. Expressed mathematically, there will be no abrupt change in $dF/dS$ experienced by the body senses of the user, i.e., there will be no sensation of bottoming. Thus, bottoming is eliminated using a mere three inches of water in the instance where the above-identified dimensions are selected. Of course it will be understood that idealizations have been made for the purposes of illustration since, for example, some property variations can occur even over one slab of foam. However, the invention has been reduced to practice and results herein described have actually been easily achieved. An essential feature, though, is to select foams having the necessary ILD to give proper support. By way of illustration, and not by way of limitation, the resilient insert 24 and resilient base 18 should preferably have an ILD in the range of 35–50 pounds, while for the resilient perimeter 20, a higher ILD of 80–90 pounds is preferred, both to give lateral rigidity for the confinement of bladder 22 and to give good seating support along the edge of the waterbed assembly 12.

Figure 7:
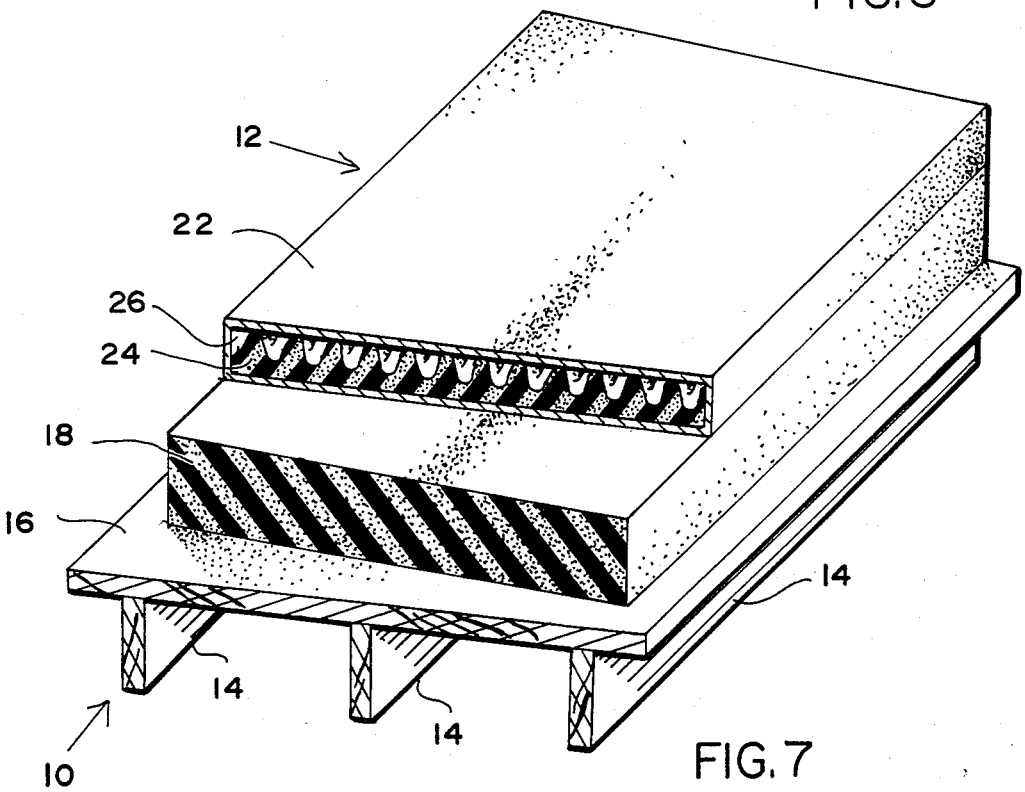
FIG. 7 is a broken cross-sectional perspective view of an alternative embodiment of the invention.

Turning to FIG. 7, an alternative embodiment of the present invention is illustrated. The invention therein described is essentially the same as illustrated by FIG. 2 except that it is absent the resilient perimeter 20 of FIG. 2. Accordingly, the waterbed assembly 12 is comprised, in FIG. 7, of the resilient base 18, bladder 22, resilient insert 24, and liquid, such as water, 26. The supporting structure 10 is comprised, as before, of pedestal members 14 and decking 16. Dimensions, for illustrative purposes only, of the waterbed assembly 12 could be expected to be similar to those described in connection with FIG. 2, and will, therefore, not be repeated.

An additional unique feature that results from the inventive structure is the ability to "fine tune" the oscillatory response of the water fill. For example, by filling the bladder 22 to the same depth as the flexible insert 24, a completely "dead" response is obtained, i.e., there are no waves at all. However, a slight overfill of, say one-half inch, results in a bed that is more "bouncy" and preferred by some. An additional, say one-quarter inch, fill results in still more bounce, and so on. The change in oscillatory response to small increments in the amount of water fill has been found to be dramatic indeed. Nevertheless, this result is obtained without any loss in the elimination of the bottoming effect as hereinabove described.

Numerous features of the present invention can be readily seen to follow from the inventive structure. For example, even though the goal of resilient insert 22 is to produce the slope-matching illustrated in FIG. 3, it is readily apparent that the presence of resilient insert 24 has a tremendous damping effect on oscillations of the water in the bladder 22. Put another way, resilient insert 24 greatly minimizes the wave phenomenon.

The hammock-like support difficulty of ordinary waterbeds also vanishes as a consequence of the inventive structure. This is because the body weight is supported largely by the resilient insert 24 in combination with the resilient base 18. As a consequence, the bladder 22 can be filled with water 26 in such a way as to leave bladder 22 quite flaccid, so that a very soft conformance to the body is provided thereby. This feature represents a significant departure from conventional waterbeds, and it can be described succinctly by stating that the water mattress simply accommodates to the contours of the body, while the resilient members 24 and 18 furnish significant support.

Assuming the illustrative dimensions, there is in the range of a seventy percent reduction in the weight of the water or alternative liquid used, a consequent reduction in the need for supporting structure further reducing weight, and the collateral concerns which resulted from the deep fill solution to bottoming are also minimized or eliminated. These include the edge sitting discomfort and tumble-in effect. It has also been found that no condensation problems arise with the present invention in the absence of heating the water. It can thus be concluded that the approximately seventy percent reduction in water fill results in the invention being able to reach thermal equilibrium with typical cyclical variations in ambient room temperature on a daily basis. This, in turn, eliminates the need for electrical heating, automatic or semiautomatic controls, and the resulting safety hazard because of electrical heating in close proximity to a large volume of water.

It will thus be seen that the invention attacks each and every of the problems outlined for conventional waterbeds, namely, the wave phenomenon, the hammock-like support dissatisfaction, the edge sitting discomfort, the tumble-in difficulty, the weight, the lack of thermal equilibrium with cyclic room temperature variations, the necessity to heat the water and to control that heating, and the safety hazard.

Having described the presently preferred embodiment of the invention, the advantages and objects of the invention will be apparent to those skilled in the art and reasonable modifications thereto are fully contemplated herein without departing from the true spirit of the invention. Accordingly, there are covered all alternatives, modifications, and equivalents as may be included within the spirit and scope of the invention as defined solely by the appended claims.

What is claimed is:

1. A modified waterbed assembly adapted to diminish the physiological sensations that are associated with "bottoming" comprising:

a bladder impermeable to, and for containing, a liquid;

a resilient insert disposed within the bladder and having a vertical dimension substantially identical to that of the bladder, which insert comprises a resiliently compressible, elastic material porous as to the liquid, said insert having, as a property, firmness characteristics defined as displacement force divided by penetration depth a resilient base disposed at least in part beneath the bladder and comprising a resiliently compressible, elastic material, with firmness characteristics defined as displacement force divided by penetration depth, that is substantially identical to the firmness characteristics of the resilient insert whereby displacement across a boundary between the insert and the base cannot be physiologically perceived;

said insert and base providing substantially all of the support to a user of the waterbed assembly while the liquid substantially serves only as a load distribution means; the thickness of the bladder being no more than approximately three inches and the thickness of the base being about four inches.

2. The modified waterbed assembly of claim 1 wherein the resilient insert is comprised of a convoluted foam.

3. The modified waterbed assembly of claim 1 wherein the liquid is water and the resilient insert is comprised of a hydrolytically stable material.

4. The modified waterbed assembly of claim 1 wherein the resilient insert has a specific gravity that is greater than the specific gravity of the liquid.

5. The modified waterbed assembly of claim 1 which further comprises a resilient perimeter member disposed about and in contact with the periphery of the bladder to laterally contain said bladder.

6. The modified waterbed assembly of claim 5 wherein the perimeter member is less compressible than the base member.

7. The modified waterbed assembly of claim 5 that is substantially equal in size to a conventional non-waterbed mattress.

8. The modified waterbed assembly of claim 1 that is substantially equal in size to a conventional non-waterbed mattress.

9. A modified waterbed adapted to diminish the physiological sensations that are associated with "bottoming" comprising:

a bladder impermeable to, and for containing, a liquid;

a resilient insert disposed within the bladder and having a vertical dimension substantially identical to that of the bladder, which insert comprises a resiliently compressible, elastic material porous as to the liquid, said insert having, as a property, firmness characteristics defined as displacement force divided by penetration depth a resilient base disposed at least in part beneath the bladder and comprising a resiliently compressible, elastic material, with firmness characteristics defined as displacement force divided by penetration depth, that is substantially identical to the firmness characteristics of the resilient insert whereby displacement across a boundary between the insert and the base cannot be physiologically perceived;

said insert and base providing substantially all of the support to a user of the waterbed assembly while the liquid substantially serves only as a load distribution means; and support structure disposed at least in part beneath the resilient base; the thickness of the bladder being no more than approximately three inches and the thickness of the base being about four inches.

10. The modified waterbed of claim 9 wherein the resilient insert is comprised of a convoluted foam.

11. The modified waterbed of claim 9 wherein the liquid is water and the resilient insert is comprised of a hydrolytically stable material.

12. The modified waterbed of claim 9 wherein the resilient insert has a specific gravity that is greater than the specific gravity of the liquid.

13. The modified waterbed of claim 9 which further comprises a resilient perimeter member disposed about and in contact with the periphery of the bladder to laterally contain said bladder.

14. The modified waterbed of claim 13 wherein the perimeter member has, as a property, a function defined as displacement divided by penetration depth which perimeter member function has a predetermined relationship that is greater than the resilient base function.

15. The modified waterbed of claim 13 that is substantially equal in size to a conventional non-waterbed mattress.

16. The modified waterbed of claim 9 that is substantially equal in size to a conventional non-waterbed mattress.

17. The modified waterbed of claim 9 wherein the support structure is comprised of decking and a plurality of pedestal members.

18. A modified waterbed adapted to diminish the physiological sensations that are associated with "bottoming" comprising:

a bladder impermeable to, and for containing water;

a resilient insert disposed within, and having a vertical dimension substantially equal to a vertical dimension of, the bladder, said insert further comprising a resiliently compressible, elastic hydrolytically stable convoluted foam which is porous as to water, said insert also having, as a property, firmness characteristics defined as displacement force divided by penetration depth a resilient base disposed at least in part beneath the bladder and comprising a resiliently compressible, elastic material, with firmness characteristics a defined as displacement force divided by penetration depth that is substantially identical to the firmness characteristics of the resilient insert whereby displacement across a boundary between the insert and the base cannot be physiologically perceived;

said insert and base providing substantially all of the support to a user of the waterbed assembly while the liquid substantially serves only as a load distribution means; and support structure disposed at least in part beneath the resilient base; the thickness of the bladder being no more than approximately three inches and the thickness of the base being about four inches.

* * * * *